US006478645B1

(12) United States Patent
Allbright et al.

(10) Patent No.: US 6,478,645 B1
(45) Date of Patent: Nov. 12, 2002

(54) MOISTURE MIGRATION INHIBITOR FOR WET MARINE EXHAUSTS, AND METHOD THEREFORE

(75) Inventors: Eddie Allbright, Covington, LA (US); Fred Inman, Sr., La Verne, CA (US)

(73) Assignee: Marine Power, Inc., Ponchatoula, LA (US)

( * ) Notice: Subject to any disclaimer, the term of this patent is extended or adjusted under 35 U.S.C. 154(b) by 0 days.

(21) Appl. No.: 09/947,605

(22) Filed: Sep. 6, 2001

(51) Int. Cl.[7] ..... B63H 21/32
(52) U.S. Cl. ..... 440/89
(58) Field of Search ..... 440/28, 89; 60/310, 60/320, 321; 187/235, 243

(56) References Cited

U.S. PATENT DOCUMENTS

| | | | | | |
|---|---|---|---|---|---|
| 3,130,541 | A | * | 4/1964 | Babbit | 440/89 |
| 4,019,456 | A | | 4/1977 | Harbert | |
| 4,589,852 | A | | 5/1986 | Price | |
| 5,133,185 | A | | 7/1992 | Gilbreath et al. | |
| 6,035,633 | A | * | 3/2000 | Woods | 440/89 |

* cited by examiner

*Primary Examiner*—Ed Swinehart
(74) *Attorney, Agent, or Firm*—Joseph T. Regard, Ltd.

(57) ABSTRACT

A moisture inhibitor system for wet exhausts as utilized in marine applications such as boats and other watercraft. The preferred embodiment of the present invention contemplates an exhaust manifold having an inner exhaust passage which has situated therein a collection barrier or raised pocket situated to collect moisture migrating from the exhaust port, generally at the stern of the vessel. The collection pocket is heated by the exhaust stream, and is formed to collect and retain the migrating moisture, while simultaneously the heated walls of the collection barrier evaporate the collected moisture forming moisture vapor, which moisture vapor is urged through the exhaust passage and the exhaust port, where it is leaves the system. The system thereby prevents moisture migrating up the exhaust passage from reaching the engine. In the preferred embodiment of the invention, the exhaust pipe includes a generally vertical portion emanating from the engine, and an elbow at the top of the vertical portion communicating with an exhaust conduit situated generally horizontally, but with a slightly downwardly angled path leading to the exhaust port at the stern of the vessel. In this embodiment, the moisture collection pocket is situated in the lower inner portion of the generally horizontal exhaust conduit, in the vicinity of the elbow. The collection pocket is configured so as to provide minimal disturbance in the flow of exhaust through the system. An alternative embodiment of the present invention contemplates a moisture collection pocket formed inside portion of the the manifold elbow near the manifold opening at the engine head.

7 Claims, 5 Drawing Sheets

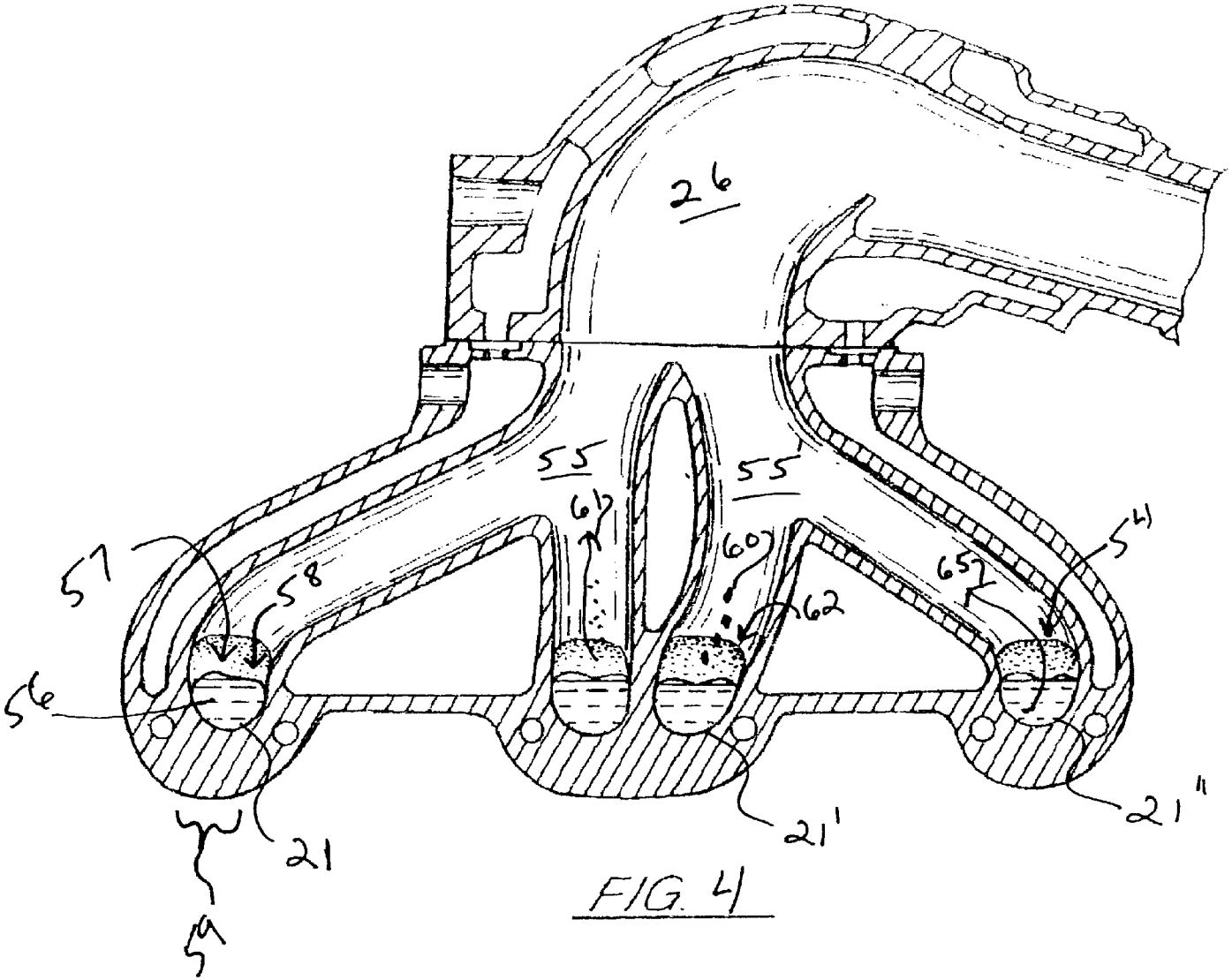
21
21'
21'
21
55
55
55

MOISTURE MIGRATION INHIBITOR FOR WET MARINE EXHAUSTS, AND METHOD THEREFORE

TECHNICAL FIELD OF THE INVENTION

The present invention relates to improvements in exhaust manifolds, and in particular to a moisture inhibitor system for wet exhausts as utilized in marine applications such as boats and other watercraft.

The preferred embodiment of the present invention contemplates an exhaust manifold having an inner exhaust passage which has situated therein a collection barrier or raised pocket situated to collect moisture migrating from the exhaust port, generally at the stern of the vessel.

The collection pocket is heated by the exhaust stream, and is formed to collect and retain the migrating moisture, while simultaneously evaporating (via stored heat from the exhaust stream) the collected moisture forming moisture vapor, which moisture vapor is urged by the exhaust stream through the exhaust passage and the exhaust port, where it leaves the system. The system thereby prevents moisture migrating up the exhaust passage from reaching the engine. The collection pocket is configured so as to provide minimal disturbance in the flow of exhaust through the system.

In the preferred embodiment of the invention, the exhaust pipe includes a generally vertical portion emanating from the engine, and an elbow at the top of the vertical portion communicating with an exhaust conduit situated generally horizontally, but with a slightly downwardly angled path leading to the exhaust port at the stern of the vessel. In this embodiment, the moisture collection pocket is situated in the lower inner portion of the generally horizontal exhaust conduit, in the vicinity of the elbow.

An alternative embodiment of the present invention contemplates a moisture collection pocket formed inside portion of the manifold elbow adjacent to the manifold opening at the engine head.

BACKGROUND OF THE INVENTION

Inboard marine engines, as utilized in smaller boats and yachts generally vent exhaust from the engine through the stern of the vessel. Such venting is not without the potential for problems, particularly when a vessel is underway at low speed/low RPM's, when the vessel quickly reduces speed or stops, and when a vessel is idling. During such conditions, moisture droplets are prone to enter the stern exhaust passage and migrate up the exhaust conduit to the manifold, where said moisture (often salt water) can enter the engine and damage same.

Such moisture entry into the exhaust system (hereinafter referred to as "reverse migration) can be due to the water physically washing up against the stern, and/or can be blown into the vicinity of the stern exhaust via the "station wagon effect" when the vessel is underway. The compression stroke of an internal combustion engine, particularly one which is not perfectly tuned, can include a somewhat substantial, yet brief, suction during the exhaust cycle, which suction can draw liquid moisture through the exhaust conduit to the engine head if left unchecked. Such exhaust migration to the head of the engine can destroy the engine over time, especially when the water contains salt.

Prior art systems have attempted various solutions to prevent this very problem, including, for example:

| Patent Number | Inventor | Date of Issue |
|---|---|---|
| 5133185 | Gilbreath | 07/28/1992 |
| 4589852 | Price | 05/20/1986 |
| 4019456 | Harbert | 04/26/1977 |

U.S. Pat. No. 5,133,185 entitled Anti Moisture Device for Engine Exhaust teaches (see FIG. 3) a lip situated at the exhaust connection to the engine to block moisture droplets travelling upstream into the exhaust duct, so as to prevent the droplets from entering the engine. It is readily noted that the '185 system is only useful for blocking relatively small amounts of moisture, the capture area formed by the lip being relatively small. If said capture area, shown as a hollow truncated conical shape, were to fill with moisture, any additional moisture would spill over directly into the head of the engine, causing catastrophic damage.

U.S. Pat. No. 4,589,852 teaches a rather complex system of baffle walls configured to allow the exhaust venting of gases from a marine engine therethrough, while preventing moisture from the riser from entering the engine. Such a configuration would represent a significant cost, may reduce performance of the engine due to unnecessary exhaust turbulence, and would require space within the vessel for placement and servicing; in a vessel such space is at a premium.

U.S. Pat. No. 4019456 issued 1977 teaches a wet exhaust system designed to prevent moisture from migrating into the system via the "station wagon effect" created when a vessel is in forward motion.

As may be discerned by a review of the above, prior art systems for preventing moisture migration in marine exhaust may be considered to have been somewhat limited in their ability to process other than small amounts of moisture, or were rather bulky and expensive to implement and maintain.

GENERAL SUMMARY DISCUSSION OF THE INVENTION

Unlike the prior art, the present invention provides an anti-moisture system to prevent the reverse migration of moisture fluid through an exhaust conduit which is compact, effective, reliable, relatively inexpensive, and which requires little in the way of maintenance.

The present invention seeks to block the reverse, upstream migration of moisture fluid from the stern of the vessel through the exhaust conduit, by providing an exhaust capturing pocket monolithically formed (in the preferred embodiment) as part of the manifold, wherein the moisture is collected, and the heat conducting metal forming the pocket and conduit quickly evaporates the collected moisture, forming moisture vapor, which is vented via the exhaust stream from the stern of the vessel.

In accomplishing this task, a system is illustrated wherein there is provided therein an internal combustion engine having a exhaust vent or manifold, the exhaust conduit forming the manifold then bending to form an elbow which directs the flow of exhaust, via a conduit, to the stern of the vessel.

Formed within in the exhaust conduit adjacent to the upper portion of the elbow, at the base of the inner wall of the conduit is a raised collection pocket having a containment aid area facing upstream of the exhaust, the collection pocket configured to collect fluid moisture creeping along the lower portion of the exhaust conduit and flash evaporate same to a vapor, where it may be vented from the vessel via the exhaust stream. The configuration and placement of the collection pocket maximizes collection of the fluids, while minimizing disturbance of exhaust gas flow from the engine.

An alternative embodiment of the present invention, which may be used separately or in concert with the preferred embodiment, contemplates collection pocket formed at the base of the exhaust manifold, within the elbow, providing a collection compartment within the exhaust manifold itself adjacent to the exhaust vent at the head of the engine.

It is therefore an object of the present invention to provide a system for preventing the reverse migration of water in an exhaust manifold.

It is another object of the present invention to provide a collection system for collecting, evaporating, and venting moisture in an exhaust manifold which may be utilized with a variety of marine exhaust systems.

It is another object of the present invention to provide a liquid collection system in marine exhaust manifolds, and method therefore, which is inexpensive to manufacture, reliable in operation, and space efficient upon implementation.

Lastly, it is an object of the present invention to provide a system for collecting and removing liquids from an exhaust manifold which may be retrofitted to existing exhaust systems.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein:

FIG. 4 is a cut-away view of the exhaust manifold and exhaust elbow of FIG. 2A, illustrating individual moisture collection pockets formed in the base elbow of each exhaust branch in the exhaust manifold.

DETAILED DESCRIPTION OF THE INVENTION

Figure 1A:
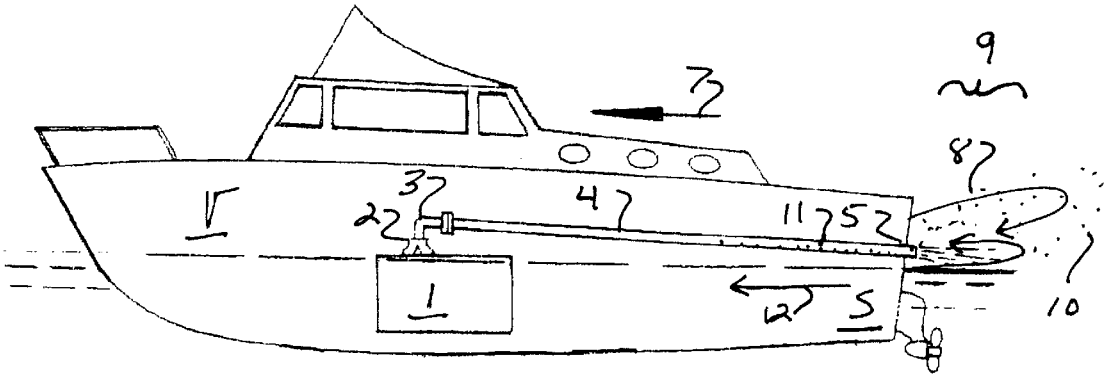
FIG. 1A is a partially cut-away view of a marine vessel traversing a body of water and generating spray, which spray is directed toward an exhaust port situated at the stern of the vessel, via the "station wagon" effect.
Figure 1B:
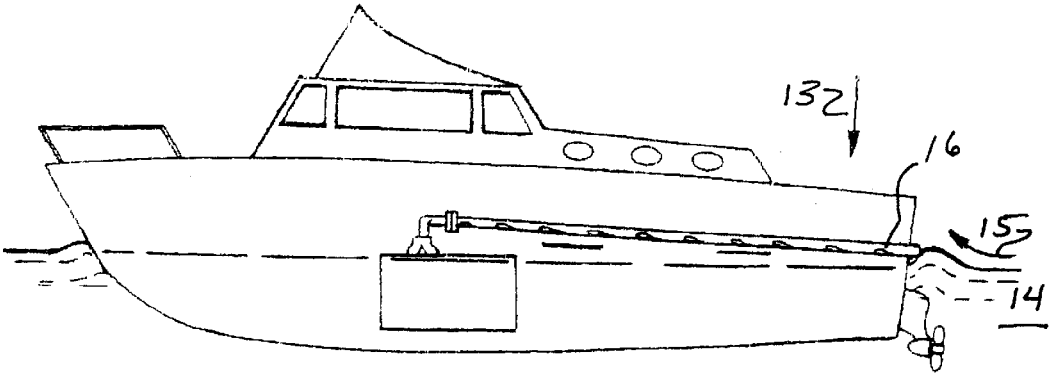
FIG. 1B is a view of the vessel of FIG. 1A, wherein the vessel has decelerated somewhat abruptly, causing the stern to lower, while simultaneously causing a wave to wash against the stern (and exhaust port) of the vessel, causing water to migrate into the exhaust system.
Figure 1C:
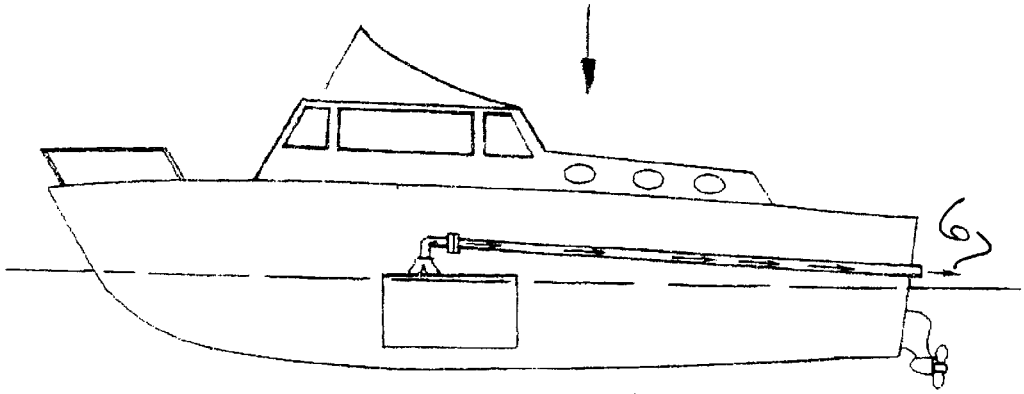
FIG. 1C is a view of the vessel of FIG. 1A, wherein the exhaust system is functioning properly, with no reverse migration of moisture up the exhaust passage.

Referring to FIGS. 1A–1C of the drawings, a marine vessel V may include a motor 1 having an exhaust manifold 2 including an elbow 3, providing an exhaust 6 conduit to a tailpipe 4 which leads to an exhaust port 5 at the stern S of the vessel.

In cruising mode, the forward motion 7 of the vessel creates air turbulence 8 creating spray 10 and a low pressure area 8 which urges spray (comprising water droplets) to the vicinity of the exhaust port 5. The motor, which comprises an internal combustion engine which may have generate suction in the exhaust during the combustion cycle. The suction can draw spray 8 into the tailpipe in the form of moisture droplets 11 which migrate 12 upstream of the exhaust to the engine 1 if unchecked, causing damage.

Another scenario where water droplets are placed into the exhaust conduit is when a marine vessel, while underway on the water 14, suddenly stops or slows, resulting in a lowering of the stern 13 and a wave 15 washing upon the stern, causing water to migrate 16 into the exhaust port and up the tailpipe.

The present invention is configured to accumulate water in the exhaust system resulting from the above scenarios, in order to prevent said water from reaching the motor.

Figure 2B:
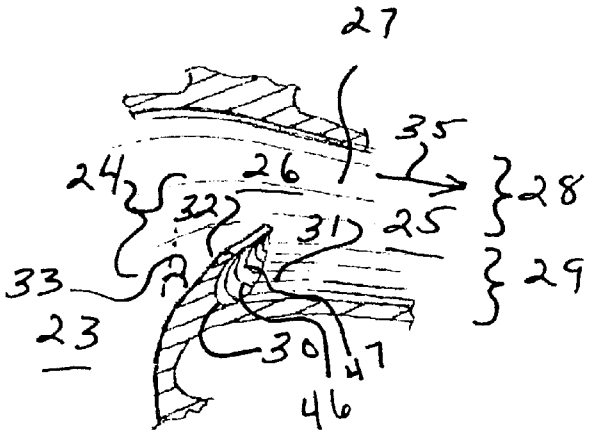
FIG. 2B is a side, partially cross-sectional view of a portion of the exhaust elbow of FIG. 2A, illustrating the moisture collection pocket of the present invention.
Figure 2A:
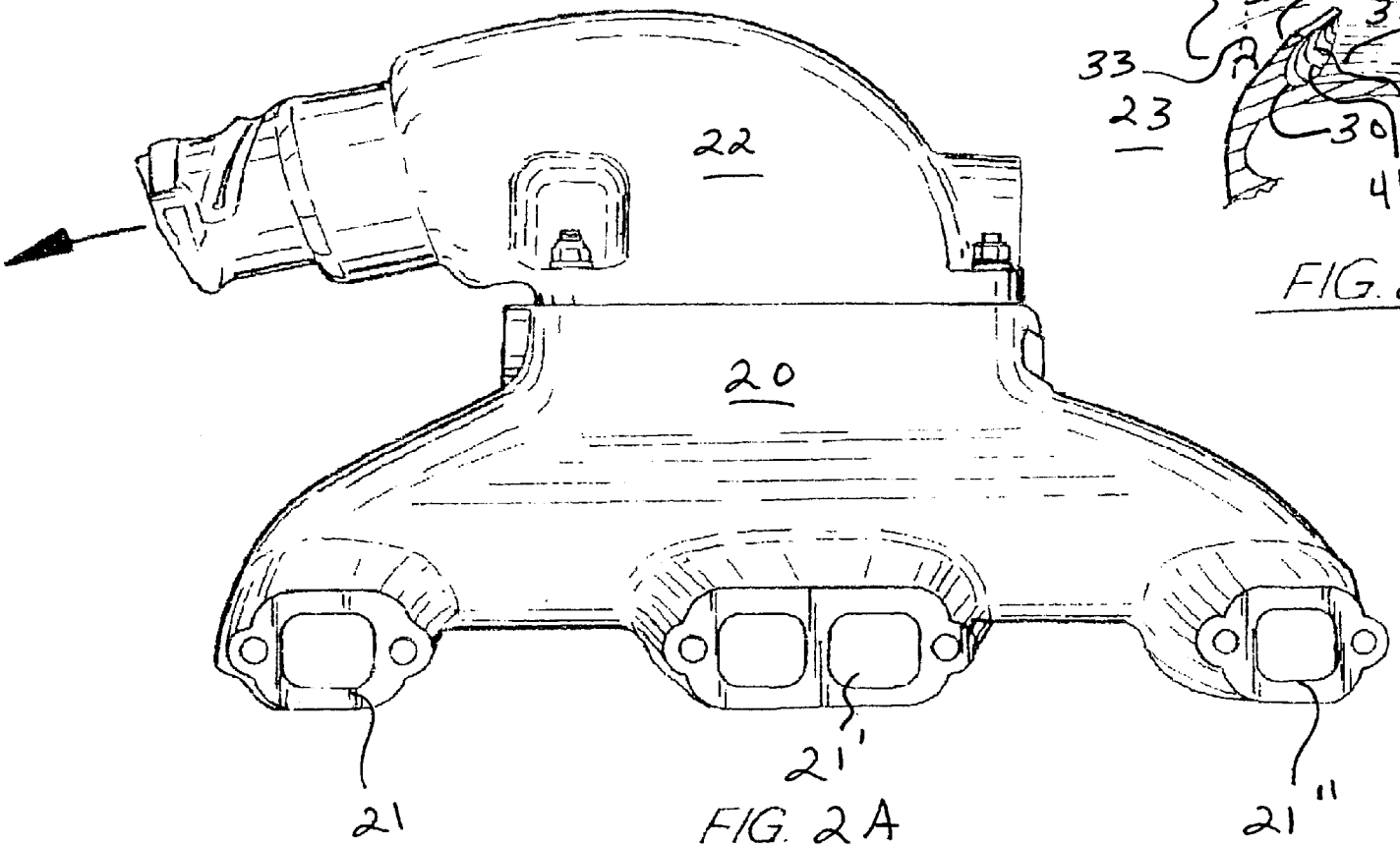
FIG. 2A is an isometric, side view of the exhaust manifold and exhaust elbow of the present invention, illustrating the exhaust head and tailpipe connection areas.
Figure 3A:
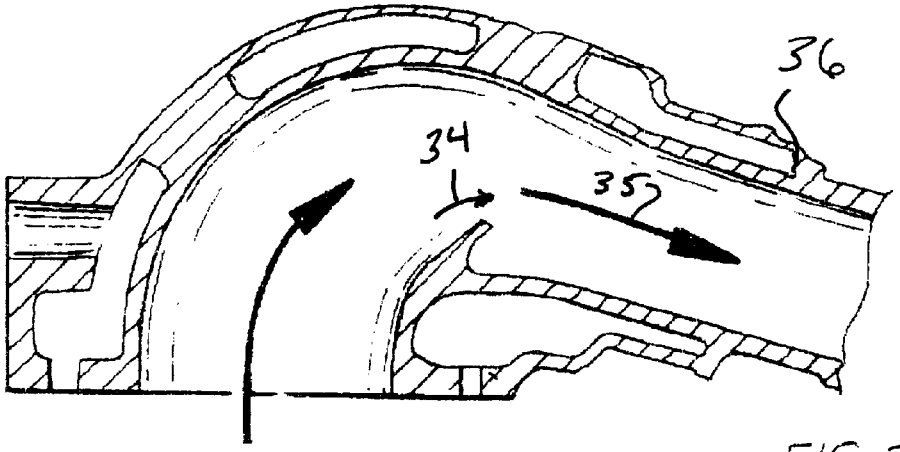
FIG. 3A is a side view, cross-sectional view of the exhaust elbow of FIG. 2A, illustrating the passage of exhaust therethrough.
Figure 3B:
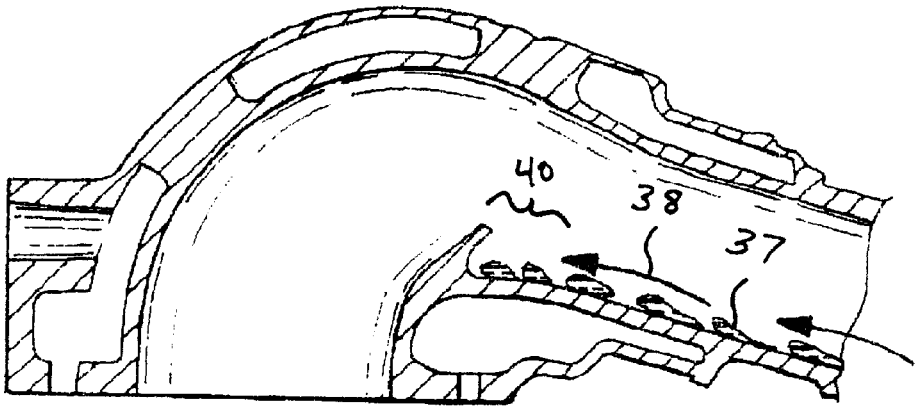
FIG. 3B is a side, cross-sectional view of the exhaust elbow of FIG. 2A, illustrating the reverse migration of liquid moisture up the tailpipe to the vicinity of the exhaust elbow.
Figure 3C:
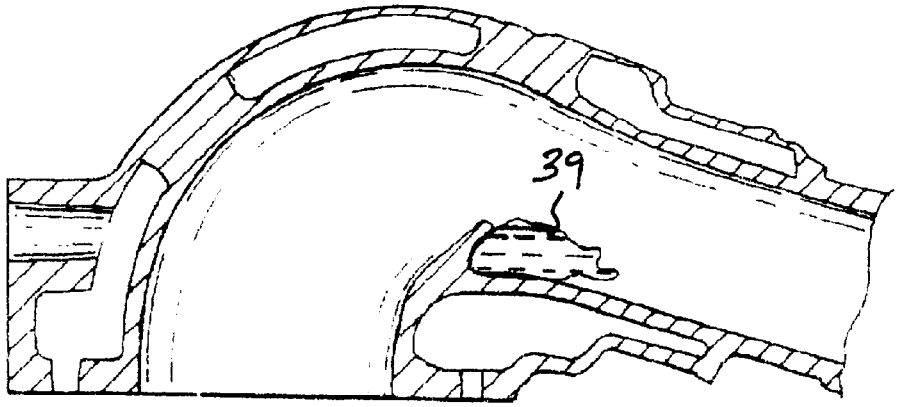
FIG. 3C is a side, cross-sectional view of the exhaust elbow of FIG. 2A, illustrating the collection of moisture shown in FIG. 3B by the collection pocket.
Figure 3D:
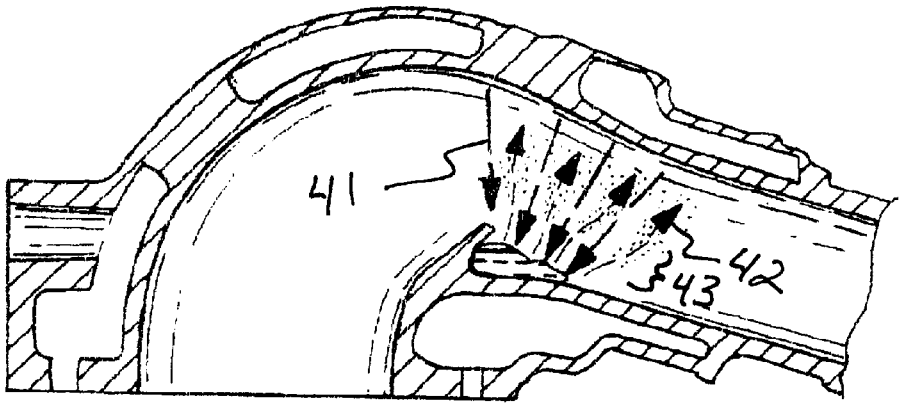
FIG. 3D is a side, cross-sectional view of the exhaust elbow of FIG. 3C, wherein the heat of the exhaust stream has heated the material forming the collection pocket so as to evaporate the moisture collected by the pocket in FIG. 3C.
Figure 3E:
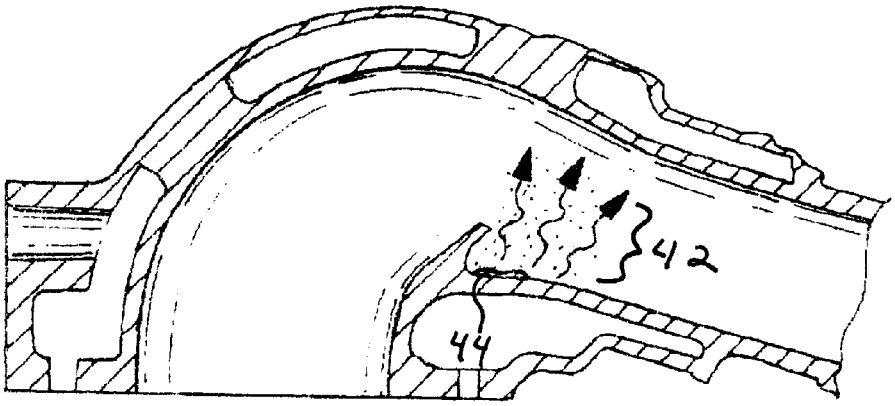
FIG. 3E is a side, cross-sectional view of the invention of FIG. 3D, wherein the moisture has substantially evaporated from the pocket, and been ejected into the exhaust stream, where it is vented out of the exhaust port.
Figure 3F:
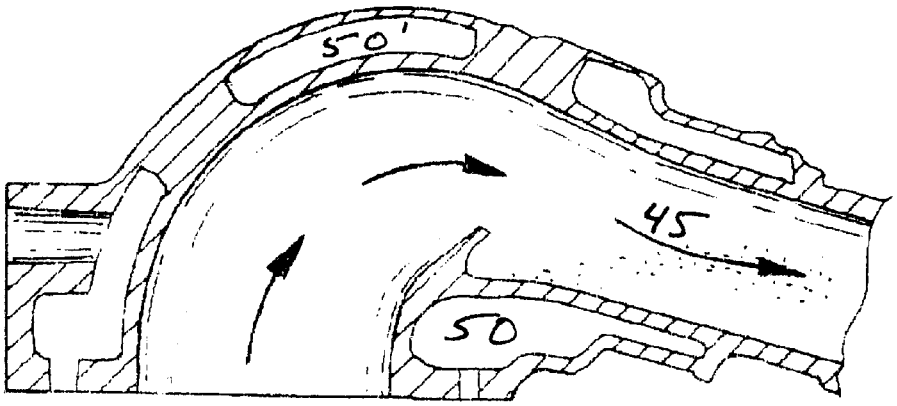
FIG. 3F is a side, cross-sectional view of the invention of FIG. 3E, wherein the liquid moisture has fully evaporated from the pocket, and has been ejected into the exhaust stream, wherein it is vented out of the exhaust port.

Continuing with FIGS. 2A–2B, the preferred embodiment of the present invention comprises an exhaust manifold 20 having exhaust inlets 21, 21', 21" communicating with the head of the engine, which inlets comprise individual branch passage leading to a single exhaust conduit 26 which communicates with an exhaust elbow 22 comprising a vertical portion 23, a bend 24, and a lateral portion 25. The exhaust conduit 26 has inner walls 27 having upper 28 and lower 29 portions.

In the vicinity of the exhaust elbow 22 preferably downstream of the the bend 24 at the lateral portion 25 is a collection pocket 30 comprising a radial, slight dip 31, a raised barrier 32 which is angled 33 downstream 34 of the exhaust flow 35. The inner wall 46 of the collection pocket 30 may be radial 47 to provide a collection area at the base of the collection pocket, with the angled 33 radial 47 wall angled 33 downstream 34 to resist moisture creeping over the raised barrier 32.

Continuing with FIGS. 2A–2B and 3A–3F, in use, the exhaust elbow 22 is connected to the tailpipe via a tailpipe connection 36 to the exhaust port at the stern of the vessel, as discussed infra. Moisture droplets 37 are urged up the tailpipe in a reverse migration 38, along the lower 29 portion of the exhaust conduit, where they collect 40 at the collection pocket 30 into a moisture pool 39. In an internal combustion engine, the exhaust is heated, which heat, in turn, heats the exhaust conduit walls to a temperature far above the boiling point of water (220 degrees F., 100 degrees C.). The heat 41 of the exhaust stream, transferred to the material (typically steel) forming the exhaust conduit, heats the moisture pool 39, evaporating 42 same into a water vapor 43 which is urged 45 through the exhaust port via the exhaust stream, diminishing 44 the moisture pool 39. As shown, the exhaust manifold and/or elbow may be jacketed 50 to moderate the temperature of the system via water flow.

Referring to FIGS. 2A–2B and 4, an alternative embodiment of the present invention which may work in concert with the preferred embodiment disclosed infra, comprises the forming of a collection pocket 57 at the base of the exhaust branches 55, 55' forming the manifold, which pocket is formed behind 62 a barrier 56 provided adjacent to the inner bend 54 forming the elbow 58, while still providing a passage 59 for the passage of the exhaust stream 65 from the engine. The barrier comprises front 64 and back 63 walls, the back wall communicating with the collected moisture and facing the inner bend 54 forming the elbow, the front wall facing the passage 59 for the exhaust stream 65.

In use, moisture 60 collects in the pocket 57 and evaporates 61 due to exhaust heating of the material forming the pocket, forming water vapor which is ejected from the exhaust conduit via the exhaust stream.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. A moisture migration inhibitor for marine exhausts comprising:

an exhaust manifold having exhaust inlets communicating with the head of an engine, said exhaust manifold having formed therein an exhaust conduit communicating with said exhaust inlets;

said exhaust conduit having inner wall having upper and lower portions, said exhaust conduit configured to receive a flow of exhaust from an engine;

a collection pocket associated with said exhaust conduit, said collection pocket comprising a raised barrier situated at an angle downstream of said exhaust flow, said raised barrier having a base and an inner wall having a radial configuration so as to provide a collection area at the base of said raised barrier.

2. The moisture migration inhibitor of claim 1, wherein said collection pocket further comprises a dip formed in said inner wall of said exhaust conduit at the based of said raised barrier.

3. The moisture migration inhibitor of claim 2, wherein said dip has a radial configuration.

4. The moisture migration inhibitor of claim 3, wherein an exhaust elbow communicates with said exhaust manifold and said exhaust conduit, said exhaust elbow comprising a first portion, an elbow bend communicating with said first portion, and a second portion lateral to said first portion, and wherein said collection pocket is formed in said second portion of said exhaust elbow.

5. A moisture migration inhibitor for marine exhausts comprising:

an exhaust manifold having exhaust inlets communicating with the head of an engine, said exhaust manifold having formed therein an exhaust conduit communicating with said exhaust inlets;

said exhaust conduit having inner wall having upper and lower portions, said exhaust conduit configured to receive a flow of exhaust from an engine said exhaust conduit forming an elbow adjacent to at least one of said exhaust inlets;

a collection pocket situated adjacent to said exhaust inlet, said collection pocket comprising a raised barrier having first and second sides, said first side spaced from said exhaust inlet to allow the passage of exhaust therebetween, said second side facing said elbow so as to form a containment area for moisture.

6. The method of preventing the migration of fluid moisture in an exhaust system conveying an exhaust flow, said exhaust system comprising a manifold and an exhaust conduit, comprising the steps of:

a. forming a collection pocket associated with said exhaust conduit, said collection pocket comprising a raised barrier situated at an angle downstream of said exhaust flow, said raised barrier having a base and an inner wall having a radial configuration so as to provide a collection area at the base of said raised barrier;

b. running exhaust flow having heat through said exhaust conduit and said collection pocket, heating said collection pocket, providing a heated collection pocket;

c. allowing liquid moisture to migrate up said exhaust conduit against said exhaust flow;

d. collecting said liquid moisture with said collection pocket, providing collected liquid moisture;

e. evaporating said collected liquid moisture using said heated collection pocket, providing moisture vapor;

f. urging said moisture vapor from said exhaust conduit utilizing said exhaust flow.

7. The method of preventing the migration of fluid moisture in an exhaust system conveying an exhaust flow, said exhaust system comprising a manifold and an exhaust conduit, comprising the steps of:

a. forming an exhaust manifold having exhaust inlets communicating with the head of an engine, said exhaust manifold having formed therein an exhaust conduit communicating with said exhaust inlets;

said exhaust conduit having inner wall having upper and lower portions, said exhaust conduit configured to receive a flow of exhaust from an engine said exhaust conduit forming an elbow adjacent to at least one of said exhaust inlets;

a collection pocket situated adjacent to said exhaust inlet, said collection pocket comprising a raised barrier having first and second sides, said first side spaced from said exhaust inlet to allow the passage of exhaust therebetween, said second side facing said elbow so as to form a containment area for moisture;

b. running exhaust flow having heat through said exhaust conduit and said collection pocket, heating said collection pocket, providing a heated collection pocket;

c. allowing liquid moisture to migrate up said exhaust conduit against said exhaust flow;

d. collecting said liquid moisture with said collection pocket, providing collected liquid moisture;

e. evaporating said collected liquid moisture using said heated collection pocket, providing moisture vapor;

f. urging said moisture vapor from said exhaust conduit utilizing said exhaust flow.

* * * * *